US006322318B1

(12) United States Patent
Radosevich

(10) Patent No.: US 6,322,318 B1
(45) Date of Patent: Nov. 27, 2001

(54) BLOWER PACKAGE AND METHOD OF USE

(76) Inventor: Paul T. Radosevich, 15129 Park Dr., Dayton, MN (US) 55327

( * ) Notice: Subject to any disclaimer, the term of this patent is extended or adjusted under 35 U.S.C. 154(b) by 0 days.

(21) Appl. No.: 09/549,398

(22) Filed: Apr. 14, 2000

(51) Int. Cl.[7] ..... F01D 25/04; F03B 11/04
(52) U.S. Cl. ..... 415/1; 415/119; 415/201
(58) Field of Search ..... 415/119, 121.2, 415/182.1, 201, 208.1, 211.2, 1

(56) References Cited

U.S. PATENT DOCUMENTS

| | | | | |
|---|---|---|---|---|
| 1,455,034 | * | 5/1923 | Small | 415/201 X |
| 4,775,294 | * | 10/1988 | LaPorte | 415/201 |
| 5,014,816 | * | 5/1991 | Dear et al. | 181/229 |
| 5,078,574 | * | 1/1992 | Olsen | 415/182.1 |
| 5,266,004 | * | 11/1993 | Tsumurai et al. | 415/121.2 X |

FOREIGN PATENT DOCUMENTS

| | | | | |
|---|---|---|---|---|
| 721859 | * | 1/1955 | (GB) | 415/119 |
| 54-16708 | * | 2/1979 | (JP) | 415/119 |
| 1-315699-A | * | 12/1989 | (JP) | 415/119 |

OTHER PUBLICATIONS

Powder/Bulk Solids—Sept. '95, 5 pages.
Powder/Bulk Solids—Apr. '99, 4 pages.
Aerzen USA, The Compact III—6 pages.
Horizon Systems, Inc., Vacuum Blower Package—23 pages.
Horizon Systems, Inc., Pressure Blower Package—2 pages.
Universal Blower Pac, Inc., 2 pages.
Nu–Con Equipment, Blower and Vacuum Package—3 pages.
Boedecker Co., Blower and Vacuum Package—2 pages.
MAC, Blower Package—9 pages.

* cited by examiner

*Primary Examiner*—John E. Ryznic
(74) *Attorney, Agent, or Firm*—Angenehm Law Firm; N. Paul Friederichs; William C. Flynn

(57) ABSTRACT

A blower module which is sufficiently quiet to be placed in occupied buildings and not require the construction of a separate blower building; each blower module is a cylinder having conic drip cap on its top, a positive displacement blower, typically, a rotary piston or Roots type blower, and electric or otherwise powered motor to drive the blower, a labyrinth passage outlet silencer, and a labyrinth passage inlet silencer; and the blower module being shaped for sanitation, mechanical containment, noise abatement and stacking one blower on top of another.

17 Claims, 2 Drawing Sheets

BLOWER PACKAGE AND METHOD OF USE

BACKGROUND OF THE INVENTION

In the field of moving materials, it is often necessary to move bulk materials such as grain, sand, or other bulk material having small particle size. While the bulk materials can be moved by mechanical means, such as shovels, conveyer belts, and such where the device moving the bulk materials carries the bulk material from one location to another location these methods can be impractical and risk contaminating the bulk material. The simplest method for moving such bulk materials is to use gravity. An outlet located at the bottom of the container or bin containing the bulk material is opened and the bulk material is allowed to flow out. While this method is very useful, the bulk material must first be raised into the container or bin so that gravity can act upon it. Typically, the movement provided by gravity is limited and at some time the bulk material must again be raised to a position that gravity can again act on the bulk material.

Blower packages are also used in soil remediation and other processes.

It has become common to move such bulk materials using airflow to carry the material from one location to another location within a conduit. This method is referred to as pneumatic conveying. This method is especially useful as the conduit can be routed in a fashion that occupies, or requires very little space.

In the processing of bulk material having relatively small particle size, the bulk material must frequently be moved from one location to another quickly and efficiently. A commonly used method is to inject compressed air or gas into the conduit at the beginning of the system to push the bulk material through the conduit. This method is commonly referred to as dilute-phase, pressure, pneumatic conveying. Using either of these methods, the bulk material can be moved horizontally or vertically over some distance quickly and efficiently. Another commonly used method is to evacuate a container that is connected to the conduit at the end of the system, drawing air or gas through the conduit to pull the bulk material through the conduit. This method is commonly referred to as dilute-phase, vacuum, pneumatic conveying.

To move the bulk material in a dilute-phase, pressure, pneumatic conveying system, a blower must produce a sufficient volume of compressed air at a sufficient pressure to move the bulk material and keep the bulk material moving in the conduit. Similarly, in a dilute-phase, vacuum, pneumatic conveying system, to move bulk material, a blower package must remove sufficient volume of air to produce a sufficient vacuum to move the bulk material and keep the bulk material moving in the conduit. When the volume and/or pressure or vacuum of air is insufficient to keep the bulk material moving, the conduit can become obstructed as the bulk material settles from the air stream and is no longer being moved. An obstructed conduit creates a stoppage of flow which usually requires the intervention of workers to clear and would thus slow if not stop the transfer process, if not other processes that depend from the transfer process.

While the use of airflow to move bulk materials is efficient, it is not without problems. Blower packages used are often very large assemblies of components including: A structural base, an inlet filter/silencer, outlet filter/silencer, blower, motor, drive, drive guard, piping & fittings, and support brackets all assembled in an unsanitary, exposed fashion. One of the primary problems is that the blower package is very noisy. Most blower packages create sufficient noise that they must be housed in a separate room so that the sound does not injure the employees. Separate rooms create additional expense of the building, use more floor space, and require longer piping to provide or evacuate the air from the point of use. Longer piping results in greater airflow restriction which, directly results in wasted energy consumption over the useful life of the system.

Much of the blower noise is caused rapid movement of air through the blower and by the mechanical action of the blower acting upon the air. The mechanical noise of displacing the air often is transmitted through both the inlet and outlet of the blower to connecting piping, then radiates to the exterior environment. Conventional wisdom has been to use chambered silencers or absorptive filters to absorb the sound waves coming from the blower. While this method does reduce noise, it all too often does not sufficiently reduce the noise to allow the blower package to be placed in an occupied space. Additionally, a large percentage of the noise radiates from the blower housing and can only be reduced by some means of secondary containment that permits air to flow in contact with the blower housing to dissipate heat, generated by its operation.

Placement of a blower in a separate building, while removing the noise from the occupied area, causes increased pressure losses and a reduction in the volume of air produced by the blower. Frequently the loss of pressure and volume is sufficient so that a larger blower and/or greater horsepower motor must be used thereby increasing costs and energy requirements.

SUMMARY OF THE INVENTION

The invention relates to a modular blower and housing for creating a pressure differential for movement of air or gas. More particularly, the invention is a unique blower package for producing a large volume of compressed air which is often used to push bulk materials through a conduit; or for producing a partial vacuum which is often used to pull bulk materials through a conduit.

The invention described herein is a blower package which consolidates the function of several necessary components into a sanitary unit that is sufficiently quiet to be placed in occupied places and not require that it is remotely located. Each blower module is a cylinder having conic drip cap on its top. Each module contains a positive displacement blower, typically, a rotary lobed or Roots type blower, connecting drive components and electric or otherwise powered motor to drive the blower, a labyrinth passage outlet silencer, and a labyrinth passage inlet silencer. When used to provide positive pressure air, the module also has an inlet air filter which also provides some absorptive silencing. Multiple modules may be stacked one atop another to increase the blower output without using more floor space.

DESCRIPTION OF THE PREFERRED EMBODIMENT

Figure 1:
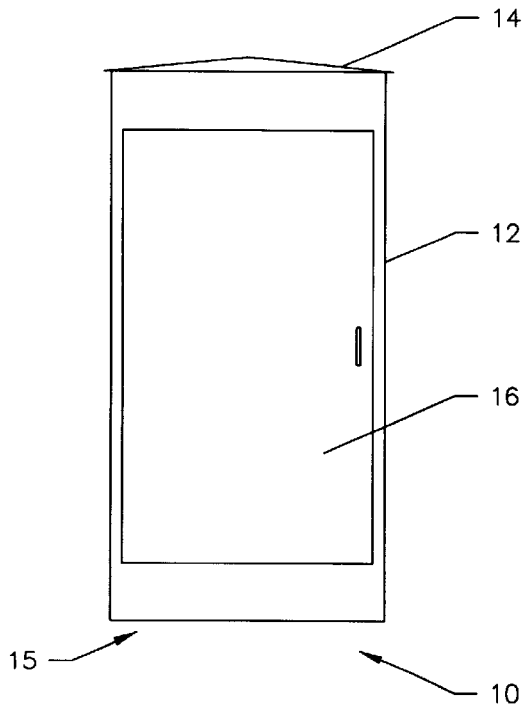
FIG. 1 is an overall view of the exterior of a blower module.
Figure 2:
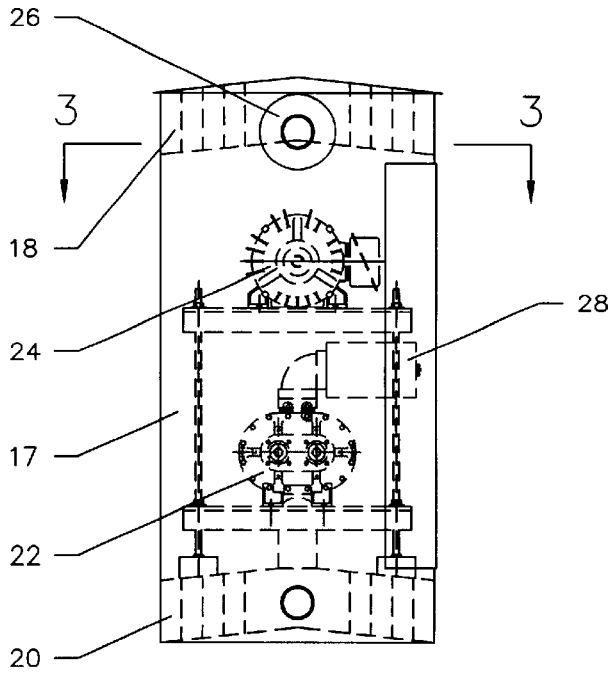
FIG. 2 is a partial cut away view showing the overall construction of a blower module and its major components.

The blower module 10 is a cylindrical housing 12, has a conic drip cap 14, a bottom conic cap 15, an access door 16, an inlet labyrinth silencer 18, and an outlet labyrinth silencer 20. Contained within the cylindrical housing 12 is a blower 22 and its associated drive motor 24. The inlet labyrinth silencer 18 and the outlet labyrinth silencer 20 may be exchanged if the invention is used in a partial vacuum application instead of a compressed air application.

The cylindrical housing 12 is the outer housing of the blower module 10 and may be formed from any suitable material such as plastic or metal. The cylindrical housing 12 material must be sufficiently malleable to be formed into a cylindrical shape using commonly available mechanisms and more importantly should have sufficient strength to allow multiple blower modules 10 to be stacked one atop another. Similarly, the drip cap 14 and access door 16 must share the same properties. Additionally, the access door 16 should be sealed when closed to achieve the maximum effectiveness of the invention. It has been found that 12 gauge sheet iron has suitable properties for fabrication of the cylindrical housing 12, the drip cap 14 and the access door 16 and is readily available and relatively inexpensive.

The access door 16 is preferably hinged and/or bolted for easy access to the interior of the cylindrical housing 12. When the access door 16 is closed, there is a door seal (not shown) between the access door 16 and the cylindrical housing 12. The door seal helps eliminate air leakage through the access door 16 opening during operation. Was air to flow through the access door 16 opening during operation, the air would decrease the efficiency of the blower module 10 and would also create noise obviating the quieting advantages of the blower module 10. The space container within the cylindrical housing 12 forms an air plenum 17 which moderates and feeds air to the blower 22. The drip cap 14 and the bottom conic cap 15 must have similar properties to the cylindrical housing 12 and is preferably constructed from the same material.

The blower 22 is a conventional blower and may be a centrifugal, screw type, or any other type of blower capable of producing sufficient quantity of fluid movement at sufficient volume and pressure. The blower 22 draws air from the plenum 17 and outputs the pumped air to the inlet port 41 of the output silencer 20. It is preferred that the blower 22 be a positive displacement blower such as a rotary lobed or Roots type. Blowers 22 of this type are readily available in a variety of sizes and may be selected from multiple sources in the marketplace. The drive motor 24 may be any power source having sufficient power to drive the blower 22 of the selected size. Preferably, the drive motor 24 is a totally enclosed fan cooled electric motor. Electric motors of this type are well known in the art and available in numerous sizes and configurations from multiple sources such as General Electric, Westinghouse, Baldor and others.

A preliminary air filter 26 may be located external to the cylindrical housing 12 for additional filtration. When used it is attached to pass air through a passage 27 in the cylindrical housing 12. The preliminary air filter 26 may function to filter particulate and other debris from the intake air. The preliminary air filter 26 also provides some silencing of the intake air stream. The preliminary air filter 26 is a conventional absorptive type air filter that may be of any conventional construction, such as, pleated paper, felt or foam having the properties of low flow restriction. The preliminary air filter 26 is also readily accessible for maintenance as it can collect a substantial amount of particulate and may need to be changed quite often. A secondary air filter 28 is located attached to the blower 22 inlet port. The secondary air filter accepts the pre-filtered air from the preliminary air filter 26 provides further filtration and sound absorption. The secondary air filter 28 is designed to filter smaller particles than the preliminary air filter 26 since the coarser particles have already been removed from the air stream. The secondary air filter 28 is also designed to filter particulate that may be generated from the drive components contained within the air plenum 17. The secondary air filter 28 also provides some silencing of the intake air stream. The secondary air filter 28 may be a conventional absorptive type air filter. The secondary air filter 28 may be constructed of any suitable filtration media having the properties of low flow restriction and removable of sufficiently small particles and may be constructed in any suitable form such as, pleated paper or foam, with or without oiling.

Figure 4:
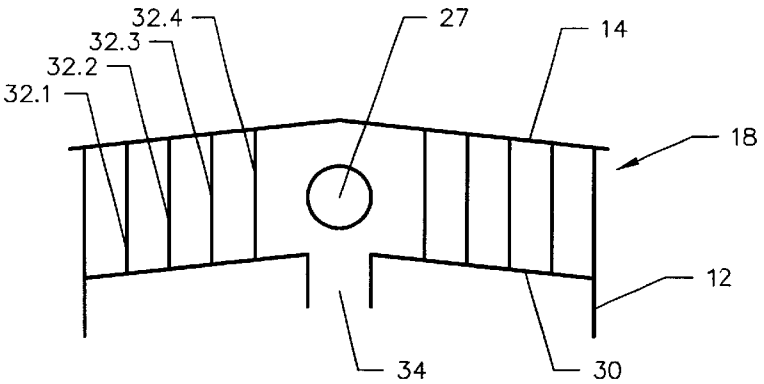
FIG. 4 is a cross sectional view of one of the labyrinth passage inlet silencers taken from line 4—4 of FIG. 3.
Figure 5:
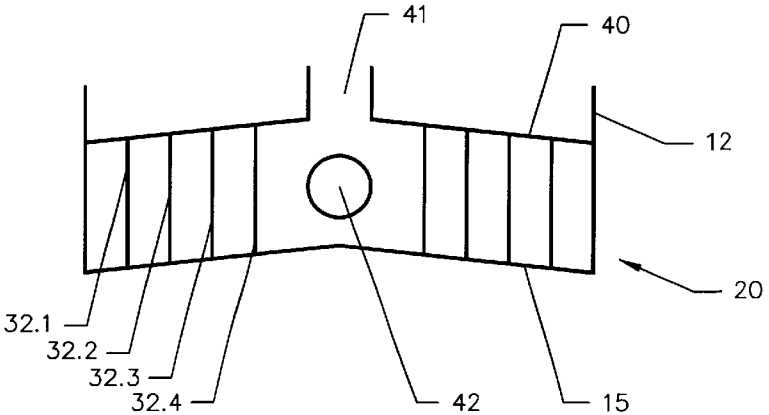
FIG. 5 is a cross sectional view of one of the labyrinth passage outlet silencers similar in cut location to the inlet silencer cross-section shown in FIG. 4.
Figure 3:
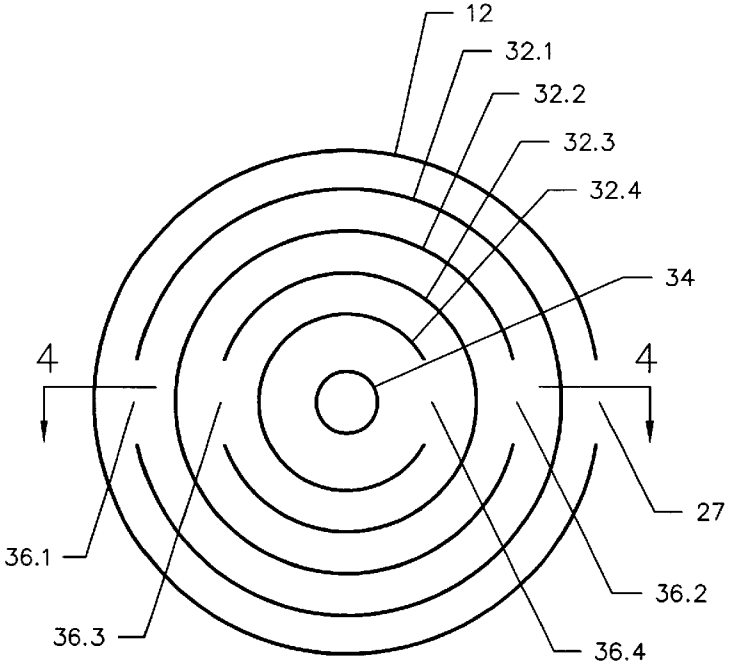
FIG. 3 is an overhead cross sectional view of one of the labyrinth passage silencers taken from line 3—3 of FIG. 2.

The labyrinth inlet silencer 18 is a cylindrical extension formed in the upper terminus of the cylindrical housing 12 and has as its top the drip cap 14. The bottom plate 30 is installed parallel to the drip cap 14 and also is formed in a conic shape. The baffles, generally, 32 are located concentrically within the cylindrical housing 12 and about the outlet port 34 as more clearly shown in FIG. 3 or FIG. 4. Each baffle 32 is a ring extending from the bottom panel 30 to the drip cap 14 and is sealingly affixed thereto. Each baffle also has a transfer port 36 formed passing there through. Each baffle 32 is located in a spaced apart relation to the adjacent baffles 32 or cylindrical housing 12. Each respective transfer port 36 is located so that it is not aligned with an adjacent transfer port 36.

The labyrinth outlet silencer 20 is configured similar to the inlet silencer with a conical bottom plate 15 and a conical top plate 40 spaced above and parallel to the bottom plate 15. Concentric baffles 32 are located within the outer cylindrical housing 12 in a spaced apart relation to the outer cylindrical housing 12 or another baffle 32. Each baffle 32 is a ring extending from the bottom plate 15 to the top plate 40 and is sealingly affixed thereto. Transfer ports 36 are located in each respective baffle 32 and each transfer port 36 is angularly spaced from the adjacent transfer ports 36 or the outlet port 42.

As both the labyrinth inlet silencer 18 and the labyrinth outlet silencer 20 function in an identical manner, their operation will be discussed together.

The first passive noise reduction is provided by the labyrinth silencer 18, 20 is the line of sight silencing. More particularly, any noise produced by the blower 22 propagates linearly from the blower 22. Any such noise entering the labyrinth silencer 18, 20 is obstructed by the labyrinth from propagating through the labyrinth silencer 18, 20. This process prevents the radiation of sound waves from the blower 22 into the environment outside of the cylindrical housing 12 reducing the ambient noise in the work area.

The second active noise reduction is provided by the resonance of the column or flowing air in the labyrinth silencers 18. 20. As a blower 22 is operated, it will transmit discrete pulsed air into both the intake and output streams of air. The pulses are usually caused by the blower moving the air in discrete packets. This is most easily exemplified where the blower 22 is a single cylinder piston type blower or compressor. It is easier to see that in a piston type blower that as the piston descends within its cylinder, that a column of air is set into motion to fill the cylinder. When the cylinder is full and the inlet valve closes, the column of air is abruptly stopped and will often dissipate its energy in the form of noise, having a frequency corresponding to the number of reciprocations the piston makes per unit time. The noise produced from the rapid starting and stopping of the column of air is propagated outwardly from the source. When this noise is propagated into the labyrinth silencer 18 or 20 the sound waves are reflected from the baffles 32. The baffles 32 cooperating with the transfer ports 36 to provide destructive interference of this propagated noise. That is, the baffles 32 are so spaced and the transfer ports 36 are so arranged to cause the cancellation of sound waves of a particular frequency that enters the labyrinth silencer 18 or 20. While the noise cancellation has been explained with reference to a piston type blower 22, it is understood that the noise cancellation will work with other types of blowers 22 such as a rotary piston or Roots type blower.

While the exact size and spacing of the baffles 32 is intended to provide as many opportunities for noise cancellation as is practical, the cross-sectional area of the passage for air flow through the baffles 32 and the transfer ports 36 must be of sufficient area as to minimize the restriction of air flow through the labyrinth silencer 18, 20. While the exact size and spacing of the baffles 32 and location of the transfer plates can be calculated, it has been found, however, that placing approximately four baffles 32 having an approximate height of nine inches and diameters of approximately twelve, eighteen, twenty-four, and thirty inches within a thirty-five and five-eighths inch cylindrical housing 12 provides ease of fabrication, cost advantages and sufficient noise reduction when the blower 22 is a two lobed Roots type blower driven by a standard 1750 RPM electric motor. At times, the noise reduction may be enhanced by slightly changing the blower 22 speed by changing the size of the drive pulleys on either the drive motor 24 or the blower 22, or both. Changing the speed of the blower 22 will change the basic frequency of the blower noise to better match the noise cancellation frequency of the labyrinth silencer 18 or 20.

Additionally it has been discovered that the inlet labyrinth silencers 18 not only cancel noise at selected frequencies, but also, set up and enhance a vibration in the air column at a basic frequency. The intake column of air will vibrate between the inlet passage 27 and the plenum 17 in the cylindrical housing 12. When the basic frequency of the air column coincides with the frequency of the blower 22 inlet opening frequency, an increase in air pumped is noted. This is apparently caused by the moving column of air pulsing into the open blower 22 intake port and being stopped not by the inlet valving, but, by interior parts of the blower thereby providing a charge to the blower that is above ambient pressure.

Similarly, the outlet labyrinth silencer 20 not only cancels noise in the output air of the blower 22, but also, enhances the vibration in the air column at a basic frequency. The output air column will vibrate between the outlet of the blower 22 and the outlet port 42. When the basic frequency of the air column coincides with the frequency of the blower 22 outlet opening frequency, an increase in air pumped is noted. This increase is apparently caused by the moving column of air pulsing out from the open blower 22 port and scavenging additional air from the blower 22.

An additional benefit of the inlet and outlet labyrinth silencers 18, 20 is that they provide a mechanism of dampening the pulsation generated by the blower 22 by virtue of the volume of compressible air contained within the labyrinth silencers 18, 20 and the air plenum 17.

In its operation, one or more blower modules is installed in its selected location and connected to a power supply and input or output from the blower module 10 port 42 is connected into the processing system. Each blower module 10 has been previously fabricated off site and can be transported to the site and installed by persons of ordinary skill. This allows the blower modules 10 to be installed by the employees of the customer or local subcontractors which reduce the cost of installation by not requiring the manufacturer to send an installation team to the site. When space is at a premium, multiple blower modules 10 can be stacked one atop another to best utilize the available floor space. Additionally, stacking multiple modules 10 allows the input or output of multiple modules 10 to be merged where it is advantageous to use multiple modules rather than one large blower module 10.

After installation, each module can be independently controlled remotely for starting and stopping as needed in a compressed air application. When the blower module 10 is started, electrical power is applied to the drive motor 24 which turns the blower 22. As the blower 22 attains operating speed, air is drawn into the blower 22 through the secondary air filter 28 which in turn draws air from the plenum 17 and from the inlet labyrinth silencer 18. This in turn allows air to be drawn in through the preliminary air filter 26. When the blower 22 reaches operating speed, the pulsations of the air column stabilize at the basic frequency and the inlet silencer 18 cooperates with the pulsing air column to cancel the noise from the blower 22. Additionally, the pulsations cooperate with the baffles 32 in the inlet silencer 18 to urge additional air into the plenum, and thus into the blower 22 to increase the amount of air reaching the blower 22.

Similarly, when the blower 22 reaches operating speed, the air in the output silencer 20 begins to pulsate in response to the blower 22 speed. The pulsations interact with the baffles 32 and the labyrinth in the output silencer to cancel the output noise and smooth the air flow. Additionally, the pulsations cooperate with the baffles 32 in the outlet silencer 20 to urge additional air out of the blower 22 and through the outlet port.

Although the present invention has been described with reference to preferred embodiments, workers skilled in the art will recognize changes may be made in form and detail without departing from the spirit and scope of the invention.

What is claimed:

1. A modular assembly for a blower package for moving a fluid comprising:

a. a cylindrical outer case having an access door located on the periphery thereof, and a powered blower contained therein;

b. a cylindrical top inlet assembly disposed abuttingly atop the outer case having an inlet port located on the periphery thereof, the inlet assembly having a bottom plate conically indented therein and a conic top plate extending upwardly therefrom, the bottom plate further having a centrally located outlet port communicating with the outer case; and the inlet assembly further having a plurality of concentric baffle rings located concentric with the center of the inlet assembly and spanning between the bottom plate and the top plate, each of said baffle rings having a transfer port in communication with the internal and external spaces of said baffle ring, the baffle ring ports further being non-aligned; and c. a cylindrical bottom outlet assembly disposed abuttingly below the outer case having an outlet port located on the periphery thereof, the outlet assembly having a bottom plate conical indented therein and an upper plate extending conically upwardly therefrom, the top plate further having a centrally located inlet port communicating with the blower outlet; and the outlet assembly further having a plurality of concentric baffle rings located concentric with the center of the outlet assembly and spanning between the bottom plate and the top plate, each of said baffle rings having a transfer port in communication with the internal and external spaces of said baffle ring, the baffle ring ports further being non-aligned.

2. The invention as described in claim 1 wherein both the top inlet assembly and the bottom outlet assembly each have four baffles.

3. The invention as described in claim 1 wherein the transfer ports of are non aligned by approximately 180 degrees.

4. The invention as described in claim 1 wherein the degree of non alignment of the baffles of both the inlet assembly and the outlet assembly is selected to cancel noise produced by the blower at a base frequency.

5. The invention as described in claim 1 wherein the spacing of the baffles of both the inlet assembly and the outlet assembly is selected to increase the fluid blow through both the inlet assembly and the outlet assembly.

6. The invention as described in claim 1 wherein the degree of non alignment of the baffles of both the inlet assembly and the outlet assembly is selected to increase the fluid flow through both the inlet assembly and the outlet assembly.

7. A modular blower assembly for moving fluids using a pressure differential comprising a. a powered blower;

b. at least one labyrinth passage silencer in fluid communication with the blower; and c. means for stacking.

8. The invention as described in claim 7 wherein the labyrinth silencer is circular in shape.

9. The invention as described in claim 8 wherein the labyrinth silencer further comprises at least one baffle contained therein, said at least one baffle further having a transfer port formed therein.

10. The invention as described in claim 8 wherein the labyrinth silencer has four baffles.

11. The invention as described in claim 9 wherein the labyrinth silencer baffle transfer port is non-aligned with the adjacent transfer port.

12. The invention as described in claim 11 wherein the labyrinth silencer baffle transfer port is non-aligned with the adjacent transfer port by approximately 180 degrees.

13. A process for creating a pressure differential in a fluid comprising the steps of a. drawing the fluid through a labyrinth passage inlet silencer;

b. mechanically producing the pressure differential; and c. passing the fluid through a labyrinth passage outlet silencer.

14. The process described in claim 13 wherein the fluid is passed around baffles and through transfer ports formed in said baffles in both the inlet silencer and the outlet silencer.

15. The process described in claim 14 wherein the fluid is passed around four baffles and through four transfer ports formed in said baffles in both the inlet silencer and the outlet silencer.

16. The process described in claim 13 wherein the fluid is passed non-aligned transfer ports in both the inlet silencer and the outlet silencer.

17. The process described in claim 16 wherein the fluid is passed transfer ports non-aligned by approximately 180 degrees in both the inlet silencer and the outlet silencer.

* * * * *